US011239583B2

(12) United States Patent
Nagasaka et al.

(10) Patent No.: US 11,239,583 B2
(45) Date of Patent: Feb. 1, 2022

(54) CONNECTOR HAVING FITTING PROTRUSION CONNECTED TO FLAT CABLE

(71) Applicant: Yazaki Corporation, Tokyo (JP)

(72) Inventors: Naokazu Nagasaka, Shizuoka (JP); Shoichi Watai, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/069,874

(22) Filed: Oct. 14, 2020

(65) Prior Publication Data

US 2021/0119359 A1 Apr. 22, 2021

(30) Foreign Application Priority Data

Oct. 16, 2019 (JP) ..... JP2019-189379

(51) Int. Cl.

| | |
|---|---|
| ***H01R 12/59*** | (2011.01) |
| ***H01R 12/70*** | (2011.01) |
| ***H01R 12/78*** | (2011.01) |
| ***H01R 13/436*** | (2006.01) |
| ***H01R 13/447*** | (2006.01) |
| *H01R 12/77* | (2011.01) |

(52) U.S. Cl.

CPC ..... *H01R 12/592* (2013.01); *H01R 12/7005* (2013.01); *H01R 12/78* (2013.01); *H01R 13/4364* (2013.01); *H01R 13/447* (2013.01); *H01R 12/778* (2013.01)

(58) Field of Classification Search

CPC ..... H01R 12/592

See application file for complete search history.

(56) References Cited

U.S. PATENT DOCUMENTS

| | | | | |
|---|---|---|---|---|
| 5,356,308 | A * | 10/1994 | Toba | H01R 13/5219 439/422 |
| 9,178,297 | B2 | 11/2015 | Kodaira et al. | |
| 10,193,255 | B2 | 1/2019 | Ito et al. | |

FOREIGN PATENT DOCUMENTS

| | | | |
|---|---|---|---|
| EP | 1923958 | A1 | 5/2008 |
| EP | 3605741 | A1 | 2/2020 |
| JP | 2014-17361 | A | 1/2014 |
| JP | 2014-93123 | A | 5/2014 |
| JP | 2016-110994 | A | 6/2016 |
| JP | 2019-106347 | A | 6/2019 |
| JP | 2019-106368 | A | 6/2019 |
| WO | 2016/088308 | A1 | 6/2016 |

* cited by examiner

*Primary Examiner* — Ross N Gushi

(74) *Attorney, Agent, or Firm* — Kenealy Vaidya LLP

(57) ABSTRACT

A connector includes a terminal clasp, a flexible flat conductive component, a housing in which an electrical connection part of the terminal clasp protrudes out of an opening of a storage room, and a cover that covers the electrical connection part from outside together with at least part of the housing. The flexible flat conductive component includes an electrical connection region in which the electrical connection part is connected with a conductor, a peripheral region enclosing the electrical connection region, an extension region extending out of the housing and the cover connected with each other, and at least two fitting holes provided on the extension region side in the peripheral region.

7 Claims, 14 Drawing Sheets

CONNECTOR HAVING FITTING PROTRUSION CONNECTED TO FLAT CABLE

CROSS-REFERENCE TO RELATED APPLICATION(S)

The present application claims priority to and incorporates by reference the entire contents of Japanese Patent Application No. 2019-189379 filed in Japan on Oct. 16, 2019.

BACKGROUND OF THE INVENTION

1. Field of the Invention

The present invention relates to a connector.

2. Description of the Related Art

A conventionally known connector includes a terminal clasp, a housing in which the terminal clasp is stored, and a sheet conductive component (for example, a flexible printed circuit substrate (FPC)) electrically connected with the terminal clasp. In the connector, the conductive component extends out of the housing. Such connectors are disclosed in, for example, Japanese Patent Application Laid-open No. 2014-17361, Japanese Patent Application Laid-open No. 2014-93123, Japanese Patent Application Laid-open No. 2016-110994, Japanese Patent Application Laid-open No. 2019-106347, and Japanese Patent Application Laid-open No. 2019-106368.

In this connector, since the conductive component extends out of the housing, force applied to the extension is potentially transferred to a place where the terminal clasp is connected with the conductive component. In particular, when connection between the terminal clasp and the conductive component is achieved by fixation such as soldering in the connector, it is difficult to release external force transferred to the connection place. Thus, the connector has room for improvement to achieve stabilization of the quality of energization between the terminal clasp and the conductive component.

SUMMARY OF THE INVENTION

The present invention is intended to provide a connector capable of achieving stabilization of the quality of energization.

A connector according to one aspect of the present invention includes a terminal clasp; a flexible flat conductive component in which a conductor and an insulator that are flexible are stacked and formed in a flat plane, the conductor being connected with an electrical connection part of the terminal clasp provided perpendicular to the plane; a housing in which a terminal connection part of the terminal clasp is stored in a storage room and the electrical connection part of the terminal clasp protrudes out of an opening of the storage room; and a cover that is connected with the housing through insertion and covers the electrical connection part from outside together with at least part of the housing, wherein the flexible flat conductive component includes an electrical connection region in which the electrical connection part is connected with the conductor, a peripheral region enclosing the electrical connection region, an extension region extending out of the housing and the cover connected with each other, and at least two fitting holes provided on the extension region side in the peripheral region, and the housing includes an installation surface through which the opening of the storage room is provided and on which flat planes of the electrical connection region and the peripheral region are placed, and a fitting protrusion that is provided for each fitting hole perpendicularly from the installation surface and is fitted into the fitting hole without backlash.

According to another aspect of the present invention, in the connector, it is preferable that the fitting holes are provided at two corner parts, respectively, on the extension region side in the peripheral region, the two corner parts being arranged in a direction orthogonal to a direction in which the extension region extends.

According to still another aspect of the present invention, in the connector, it is preferable that the flexible flat conductive component includes at least two through-holes provided on a side opposite to the extension region side in the peripheral region, and the cover includes a protrusion that is perpendicularly provided for each through-hole and inserted into the through-hole with play when the housing and the cover are at a connection completed position.

According to still another aspect of the present invention, in the connector, it is preferable that the cover includes a lock part that presses a periphery of each through-hole in the peripheral region against the installation surface when the housing and the cover are at the connection completed position.

According to still another aspect of the present invention, in the connector, it is preferable that a holding structure configured to hold the housing and the cover at the connection completed position is provided between the housing and the cover.

According to still another aspect of the present invention, in the connector, it is preferable that the through-holes are provided at two corner parts, respectively, on the side opposite to the extension region side in the peripheral region, the two corner parts being arranged in a direction orthogonal to a direction in which the extension region extends.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention will be described below in detail with reference to the accompanying drawings. The present embodiment does not limit the present invention.

Embodiment

One embodiment of the connector according to the present invention will be described below based on FIGS. 1 to 16.

Figure 1:
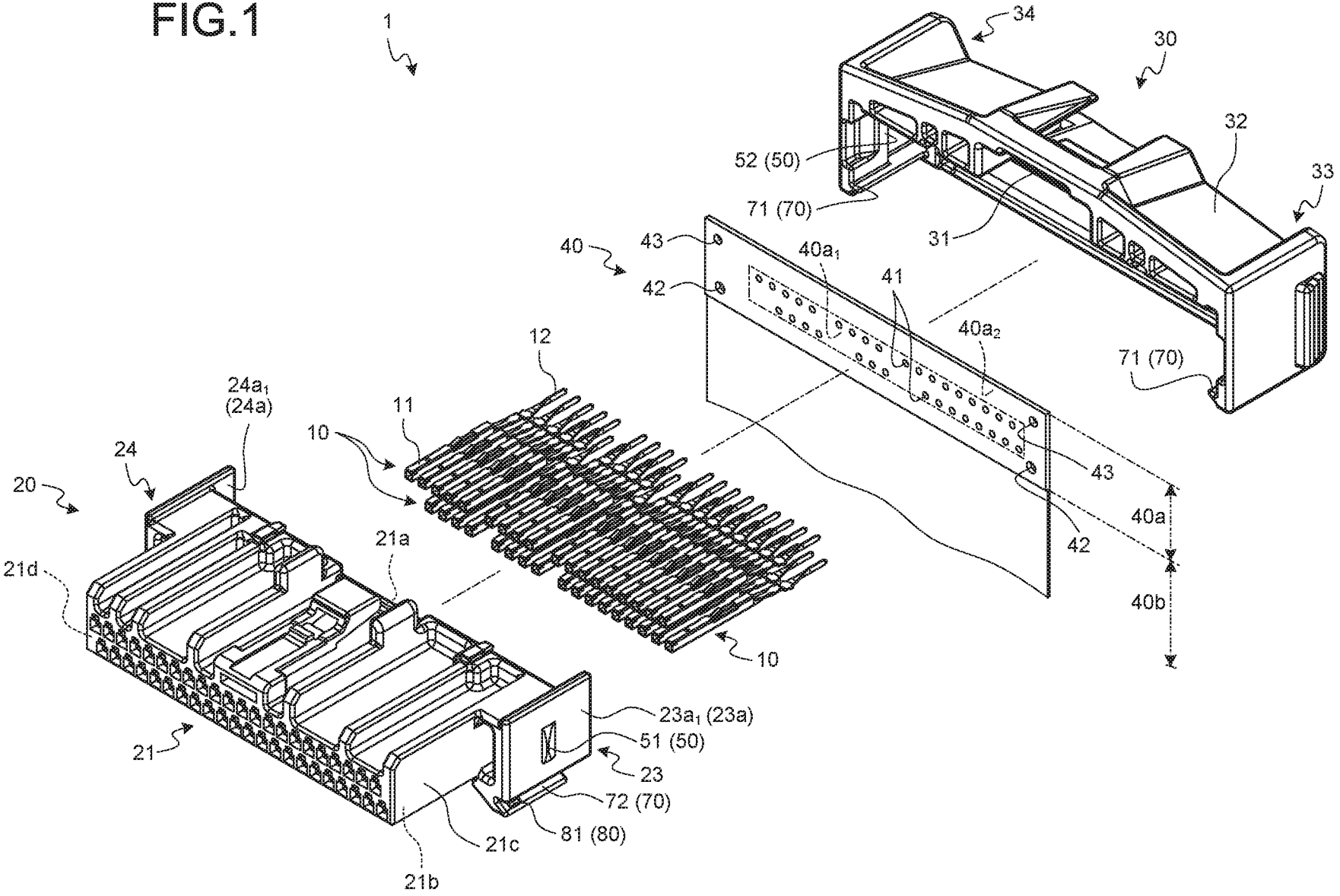
FIG. 1 is an exploded perspective view illustrating a connector of an embodiment.
Figure 2:
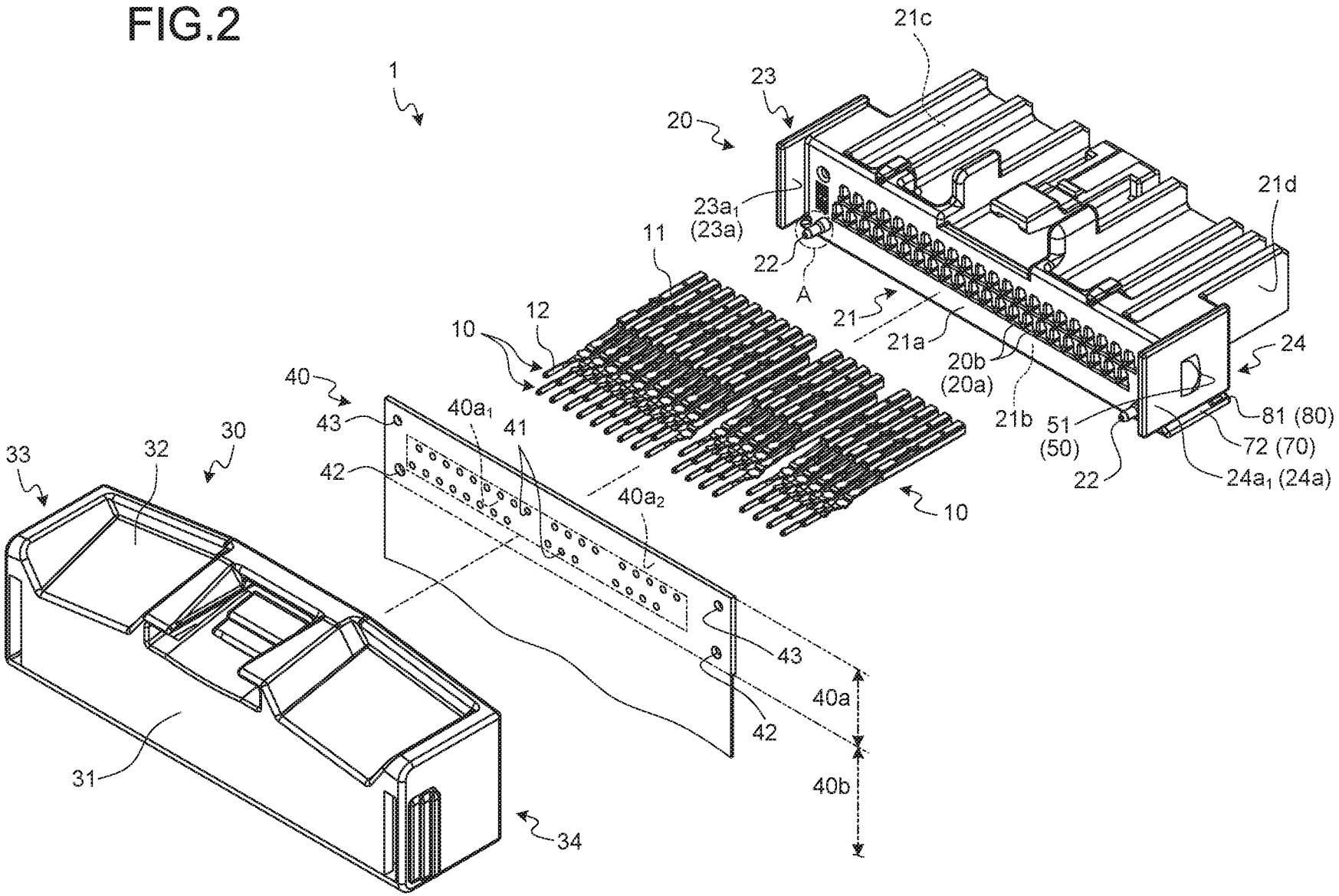
FIG. 2 is an exploded perspective view of the connector of the embodiment when viewed at a different angle.

Reference sign 1 in FIGS. 1 to 6 denotes the connector of the present embodiment. This connector 1 includes a terminal clasp 10, a housing 20 in which the terminal clasp 10 is stored and that is fitted and connected to a counterpart housing (not illustrated) of a counterpart connector in a fitting connection direction, and a cover 30 that is connected with the housing 20 through insertion and covers, from outside, at least part of the housing 20 and a conductive part (to be described later) protruding from the housing 20 (FIGS. 1 and 2).

The terminal clasp 10 is formed of a conductive material such as metal. For example, the terminal clasp 10 is formed of a metal plate as a parent material through press fabrication such as bending and cutting. The terminal clasp 10 includes a terminal connection part 11 that is physically and electrically connected with a counterpart terminal clasp (not illustrated) of the counterpart connector, and an electrical connection part 12 that is physically and electrically connected with a sheet conductive component 40 (FIGS. 1 and 2). The terminal connection part 11 is formed in, for example, a female terminal shape or a male terminal shape.

The sheet conductive component 40 is a flexible flat conductive component disposed outside the housing body 21 and connected with the electrical connection part 12 protruding out of the housing body 21. The flexible flat conductive component is a conductive component in which a conductor and an insulator that are flexible (in other words, plastic) are stacked and formed in a flat plane. For example, the flexible flat conductive component includes a plurality of conductors each forming a circuit pattern. The flexible flat conductive component is, for example, a flexible printed circuit substrate (FPC), a printing circuit structure such as a membrane wiring plate, a flat cable (FC), or a flexible flat cable (FFC).

Figure 4:
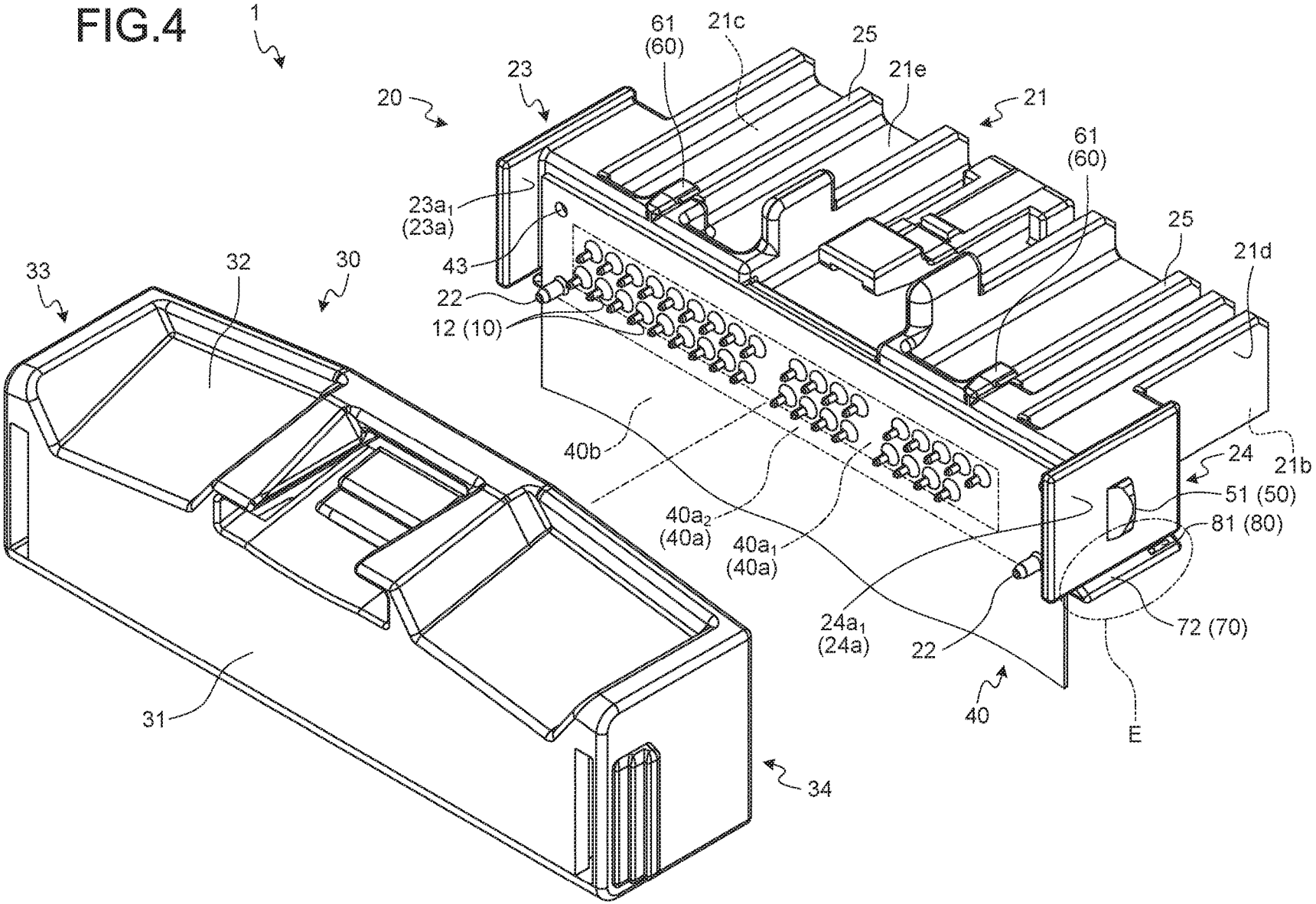
FIG. 4 is an exploded perspective view of the connector before cover connection when viewed at a different angle.
Figure 5:
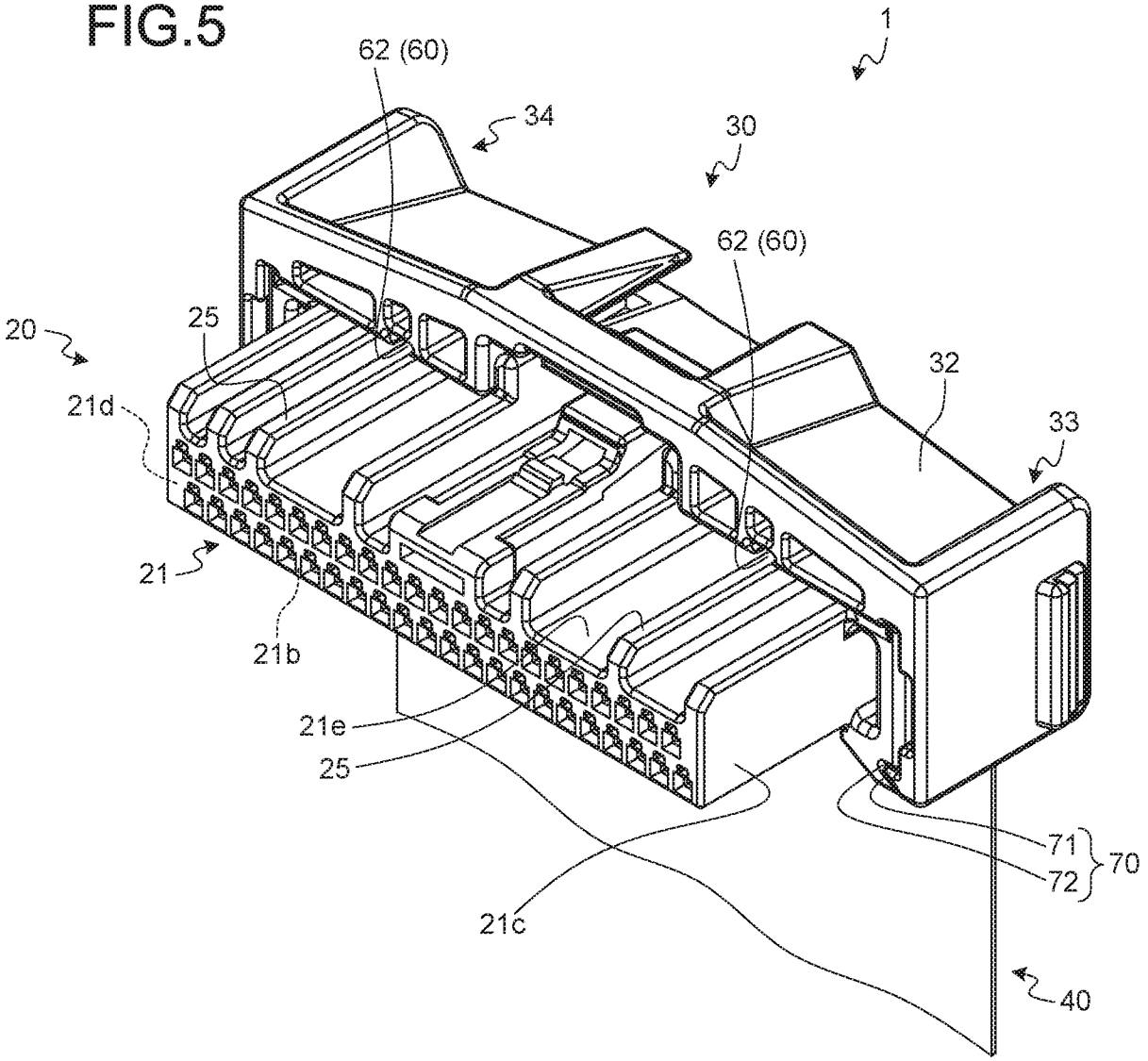
FIG. 5 is a perspective view illustrating the connector of the embodiment.

The connector 1 of the present embodiment includes one or a plurality of terminal clasps 10. The connector 1 of this example includes a plurality of terminal clasps 10, and the electrical connection part 12 of each terminal clasp 10 is physically and electrically connected with a rectangular flexible flat conductive component as the conductive component 40. In this example, each conductor (not illustrated) of the conductive component 40 is provided with one terminal clasp 10. The electrical connection part 12 of the terminal clasp 10 is provided perpendicular to the flat plane of the conductive component 40 by inserting the electrical connection part 12 into a through-hole 41 of the conductive component 40 and soldering the electrical connection part 12 to the conductor exposed at the through-hole 41 (FIGS. 1, 2, and 4). In the conductive component 40 of this example, the terminal clasps 10 are connected at one (side 40*a*) of the four sides of the conductive component 40 (FIGS. 1, 2, and 4), and accordingly, the electrical connection parts of the conductors are disposed at the side 40*a*.

The conductive component 40 includes, on the side 40*a* of the rectangle, an electrical connection region $\mathbf{40}a_1$ in which the electrical connection part 12 of each terminal clasp 10 is connected with the electrical connection part of the corresponding conductor, and a peripheral region $\mathbf{40}a_2$ enclosing the electrical connection region $\mathbf{40}a_1$ (FIGS. 1, 2, and 4). In the electrical connection region $\mathbf{40}a_1$, a through-hole 41 is formed for the electrical connection part of each conductor (the electrical connection part 12 of each terminal clasp 10). The conductive component 40 also includes an extension region 40*b* extending out of the housing 20 and the cover 30 connected with each other (FIGS. 1, 2, and 4).

The housing 20 is formed of an insulating material such as synthesis resin. The housing 20 includes a storage room 20*a* in which the terminal connection part 11 of each terminal clasp 10 is stored, and an opening 20*b* communicated with the storage room 20*a* (FIG. 2). The terminal connection part 11 is stored into the storage room 20*a* through the opening 20*b*. The housing 20 of this example includes a housing body 21 in which the terminal clasps 10 are stored (FIGS. 1 to 6). In the housing body 21, the storage room 20*a* and the opening 20*b* are formed for each terminal clasp 10. The terminal connection part 11 is inserted into the storage room 20*a* of the housing body 21 through the opening 20*b* in the fitting connection direction.

In this example, the housing body 21 is formed in a rectangular parallelepiped shape. The terminal connection part 11 of each terminal clasp 10 is stored in the storage room 20*a* in the housing body 21, and the electrical connection part 12 thereof protrudes out of one (first outer wall surface 21*a* (FIGS. 1 to 3)) of six outer wall surfaces. In this example, the opening 20*b* of each storage room 20*a* is provided to the first outer wall surface 21*a*, and the electrical connection part 12 protrudes through the opening 20*b* toward a first wall 31 (to be described later) of the cover 30 in a direction opposite to the fitting connection direction.

The flat plane of the side 40*a* (the electrical connection region $\mathbf{40}a_1$ and the peripheral region $\mathbf{40}a_2$) of the conductive component 40 is disposed opposite to and placed on the first outer wall surface 21*a*. In this manner, the first outer wall surface 21*a* is used as an installation surface for the flat plane of the side 40*a* (the electrical connection region $\mathbf{40}a_1$ and the peripheral region $\mathbf{40}a_2$). When the conductive component 40 is placed on the first outer wall surface 21*a*, each electrical connection part 12 protruding through the corresponding opening 20*b* is inserted into the through-hole 41. Each electrical connection part 12 is soldered to the electrical connection part of the corresponding conductor on the side 40*a* of the conductive component 40 outside the housing body 21. The extension region 40*b* of the conductive component 40 extends on a second outer wall surface 21*b* side of the housing body 21, which is disposed orthogonal to the first outer wall surface 21*a* (FIGS. 1 to 4).

The conductive component 40 has at least two fitting holes 42 provided on the extension region 40*b* side in the peripheral region $\mathbf{40}a_2$ (FIGS. 1 and 2). The housing 20 includes a fitting protrusion 22 that is provided for each fitting hole 42 and fitted into the fitting hole 42 without backlash (FIGS. 1, 2, and 4). Each fitting protrusion 22 is provided for the corresponding fitting hole 42 perpendicularly from the first outer wall surface 21*a* as the installation surface in the housing body 21.

Figure 7:
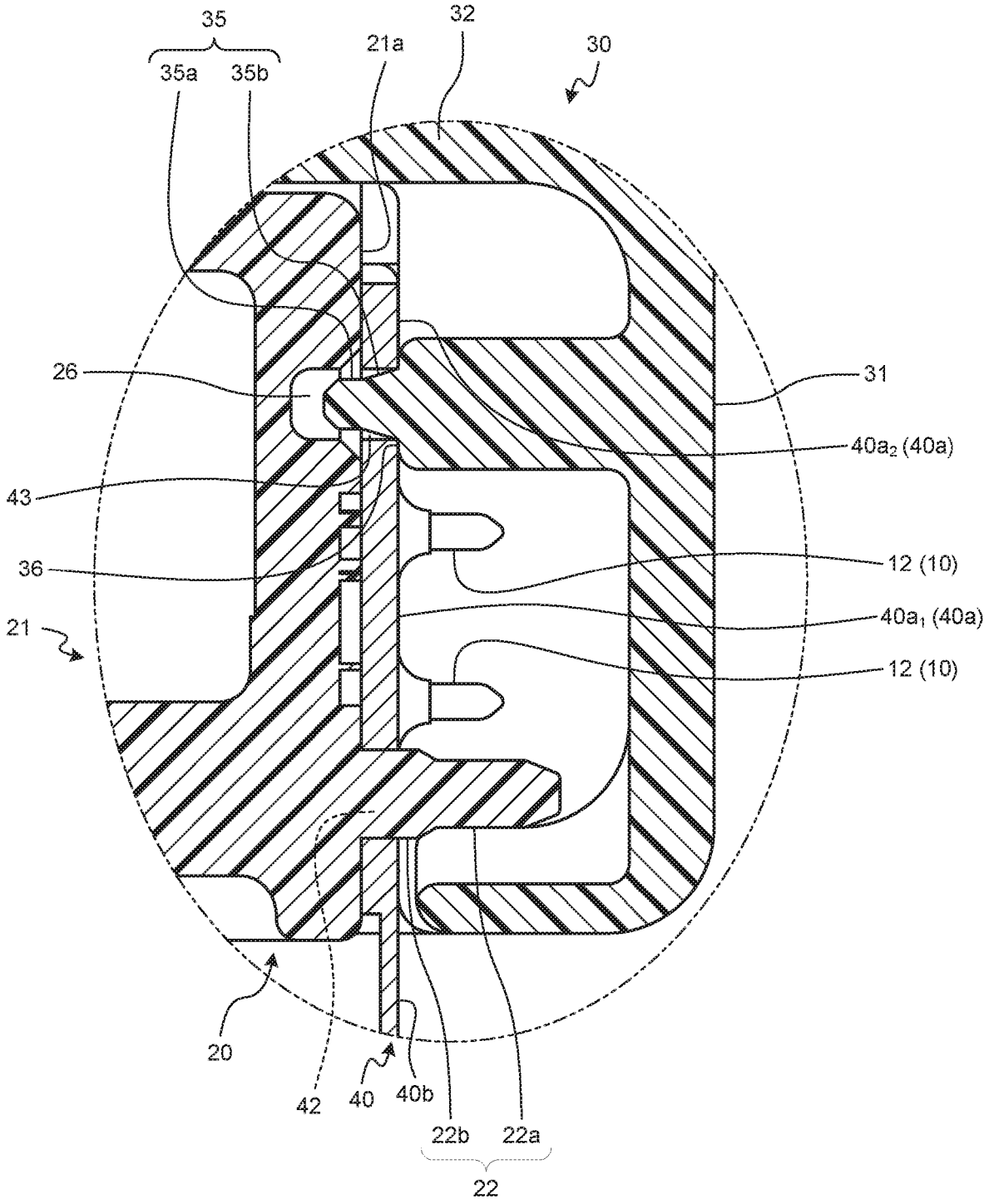
FIG. 7 is a partially enlarged diagram of a section taken along line X-X in FIG. 6.

In the connector 1, when the side 40*a* (the electrical connection region 40$a_1$ and the peripheral region 40$a_2$) of the conductive component 40 is placed on the first outer wall surface 21*a* as the installation surface, each electrical connection part 12 protruding through the corresponding opening 20*b* is inserted into the through-hole 41, and each fitting protrusion 22 is fitted into the corresponding fitting hole 42 (FIGS. 4 and 7). Accordingly, in the connector 1, when force such as pulling force is applied to the extension region 40*b* of the conductive component 40, the force is transferred from the periphery of each fitting hole 42 to the outer peripheral surface of the corresponding fitting protrusion 22. Thus, in the connector 1, the force applied to the extension region 40*b* can be received by the fitting protrusions 22. As a result, in the connector 1, the force is prevented from being transferred to the electrical connection region 40$a_1$, thus reducing application of load to a place where the electrical connection part 12 of each terminal clasp 10 is connected with the electrical connection part of the corresponding conductor in the conductive component 40. Accordingly, the connector 1 can reduce the load on the connection place and thus can achieve stabilization of the quality of energization between each terminal clasp 10 and the conductive component 40.

The fitting holes 42 are desirably provided at two corner parts, respectively, on the extension region 40*b* side of the peripheral region 40$a_2$, the two corner parts being arranged in a direction orthogonal to a direction in which the extension region 40*b* extends. For example, in the connector 1, when a fitting hole 42 is provided only at a center on the extension region 40*b* side of the peripheral region 40$a_2$ in the direction orthogonal to the extension direction, force applied to the extension region 40*b* is potentially transferred to the electrical connection region 40$a_1$ through corner parts. However, in the connector 1, when the fitting holes 42 are provided at the two corner parts, each fitting protrusion 22 is fitted into the fitting hole 42 at the corresponding corner part, and force applied to the extension region 40*b* can be received by the fitting protrusion 22 at the corner part. Thus, with such disposition of the fitting holes 42, the connector 1 can achieve a high effect of reducing a load on the place where the electrical connection part 12 of each terminal clasp 10 is connected with the electrical connection part of the corresponding conductor in the conductive component 40, thereby achieving further stabilization of the quality of energization between each terminal clasp 10 and the conductive component 40.

Figure 8:
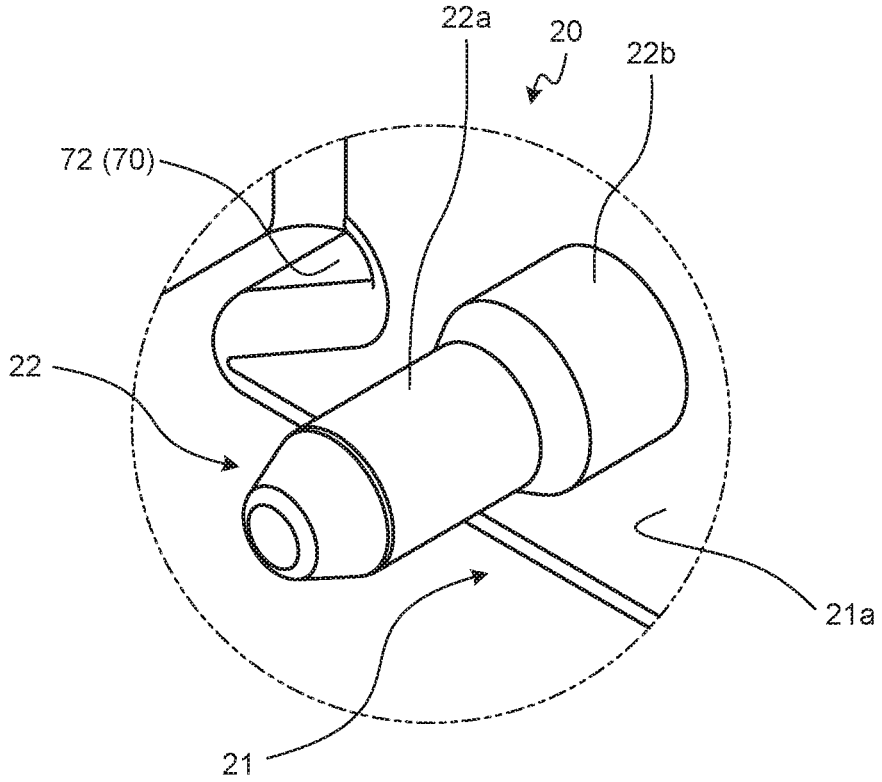
FIG. 8 is an enlarged view of Part A in FIG. 2.

In the connector 1 of this example, two pairs of a fitting hole 42 and the corresponding fitting protrusion 22 are provided at the respective corner parts. Each fitting hole 42 of this example is formed as a circular through-hole (FIGS. 1 and 2). Each fitting protrusion 22 of this example includes a cylindrical shaft 22*a* having a leading end formed in a circular truncated cone shape and having a diameter smaller than that of the corresponding fitting hole 42, and a fitting part 22*b* that is formed in a cylindrical shape having a diameter larger than that of the shaft 22*a* and is fitted into the fitting hole 42 without backlash (FIGS. 7 and 8).

Figure 3:
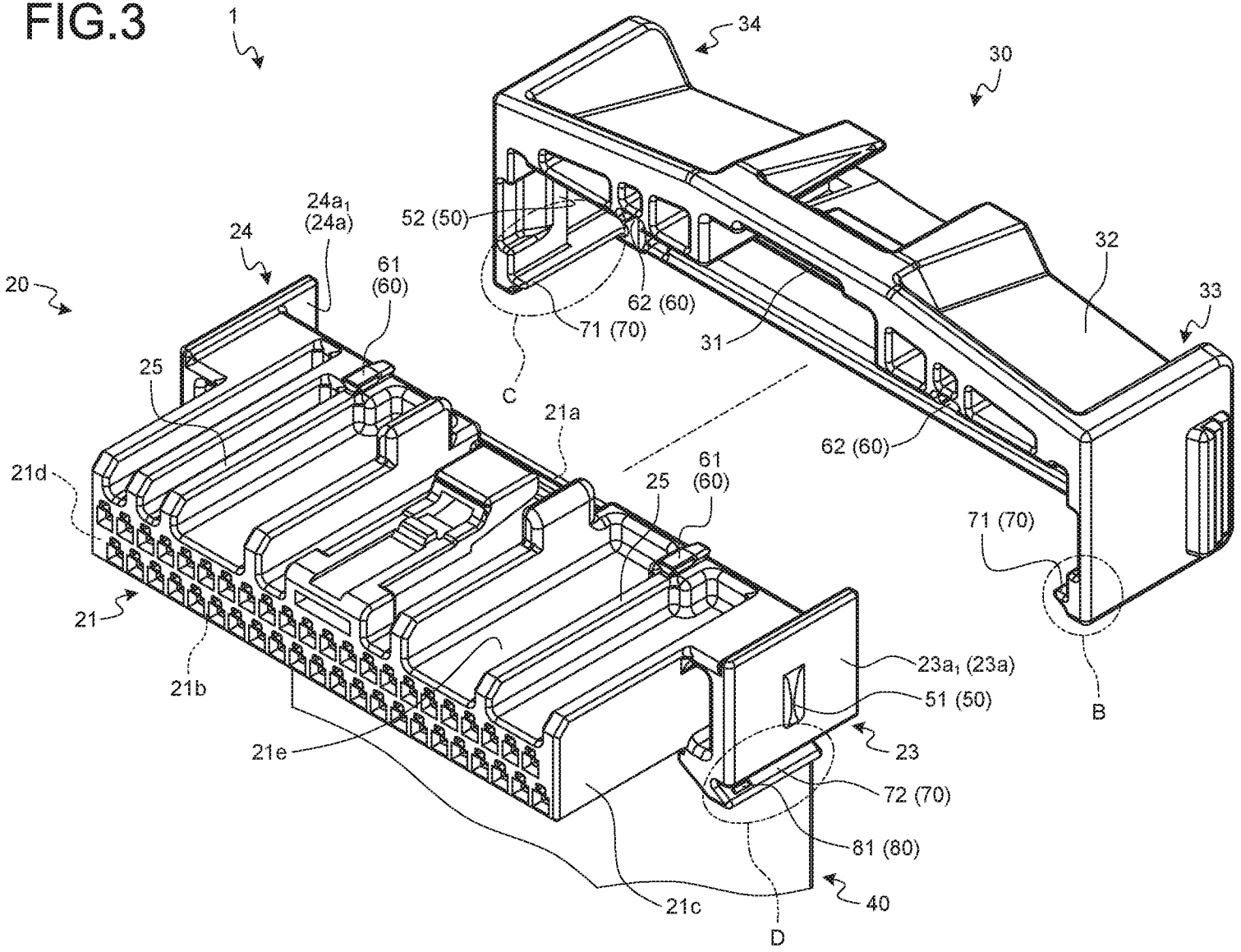
FIG. 3 is an exploded perspective view of the connector before cover connection.

The housing body 21 includes a third outer wall surface 21*c* and a fourth outer wall surface 21*d* that are disposed orthogonal to the first outer wall surface 21*a* and the second outer wall surface 21*b* (FIGS. 1 to 3). The housing 20 covers and hides the electrical connection part 12 of each terminal clasp 10 and the side 40*a* (in other words, the electrical connection part of each conductor) of the conductive component 40 from the third outer wall surface 21*c* side and the fourth outer wall surface 21*d* side, thereby protecting these components. For this, the housing 20 includes a first protection body 23 disposed opposite to and coupled with the third outer wall surface 21*c* at an interval, and a second protection body 24 disposed opposite to and coupled with the fourth outer wall surface 21*d* at an interval and protruding further than the first outer wall surface 21*a* (FIGS. 1 to 4 and 6).

The first protection body 23 of this example includes a flat plate part 23*a* having a rectangular flat plate shape, and the flat plane of the flat plate part 23*a* is disposed opposite to the third outer wall surface 21*c* at an interval (FIGS. 1 to 4 and 6). In the first protection body 23, the flat plate part 23*a* includes a protrusion part 23$a_1$ protruding further than the first outer wall surface 21*a*, and the protrusion part 23$a_1$ covers and hides the electrical connection part 12 of each terminal clasp 10 and the side 40*a* of the conductive component 40 from the third outer wall surface 21*c* side (FIGS. 1 to 4). The second protection body 24 of this example includes a flat plate part 24*a* having a rectangular flat plate shape, and the flat plane of the flat plate part 24*a* is disposed opposite to the fourth outer wall surface 21*d* at an interval (FIGS. 1 to 4 and 6). In the second protection body 24, the flat plate part 24*a* includes a protrusion part 24$a_1$ protruding further than the first outer wall surface 21*a*, and the protrusion part 24$a_1$ covers and hides the electrical connection part 12 of each terminal clasp 10 and the side 40*a* of the conductive component 40 from the fourth outer wall surface 21*d* side (FIGS. 1 to 4).

In the housing 20, a plurality of reinforcement ribs 25 are provided to the housing body 21 (FIGS. 3 to 6). The reinforcement ribs 25 protrude on a fifth outer wall surface 21*e* of the housing body 21. The fifth outer wall surface 21*e* is an outer wall surface of the housing body 21, which is disposed orthogonal to the first outer wall surface 21*a* and disposed on a side opposite to the second outer wall surface 21*b*.

The cover 30 is formed of an insulating material such as synthesis resin. The conductive part covered by the cover 30 is the electrical connection part 12 protruding out of the housing body 21 and the side 40*a* of the flexible flat conductive component as the conductive component 40. In this example, the conductive part covered by the cover 30 is the electrical connection part 12 of each terminal clasp 10 and the side 40*a* of the conductive component 40 (electrical connection part of each conductor). The cover 30 covers and hides, with the first wall 31 and a second wall 32, the electrical connection part 12 of each terminal clasp 10 and the side 40*a* of the conductive component 40, thereby protecting these components (FIGS. 1 to 4). The first wall 31 is disposed opposite to the first outer wall surface 21*a* at an interval, thereby covering and hiding the electrical connection part 12 of each terminal clasp 10 and the side 40*a* of the conductive component 40. The second wall 32 is provided continuously with the first wall 31 and disposed opposite to the fifth outer wall surface 21*e* at an interval, thereby covering and hiding the electrical connection part 12 of each terminal clasp 10 and the side 40*a* of the conductive component 40 from the fifth outer wall surface 21*e* side.

In addition, the cover 30 includes a third wall 33 disposed opposite to the first protection body 23 of the housing 20 to cover the first protection body 23 from outside, and a fourth wall 34 disposed opposite to the second protection body 24 of the housing 20 to cover the second protection body 24 from outside (FIGS. 1 to 4). The third wall 33 and the fourth wall 34 of this example are formed in rectangular flat plate shapes and flexible.

The housing 20 and the cover 30 are inserted and connected with each other in the direction orthogonal to the first outer wall surface 21*a*. In this example, the housing 20 is inserted and connected with the cover 30 from the first outer wall surface 21*a* side in a direction opposite to the fitting connection direction. When the insertion and connection of the housing 20 and the cover 30 are performed up to a connection completed position, the first outer wall surface 21*a* and the first wall 31 are positioned opposite to each other, the fifth outer wall surface 21*e* and the second wall 32 are positioned opposite to each other, the first protection body 23 and the third wall 33 are positioned opposite to each other, and the second protection body 24 and the fourth wall 34 are positioned opposite to each other.

Figure 9:
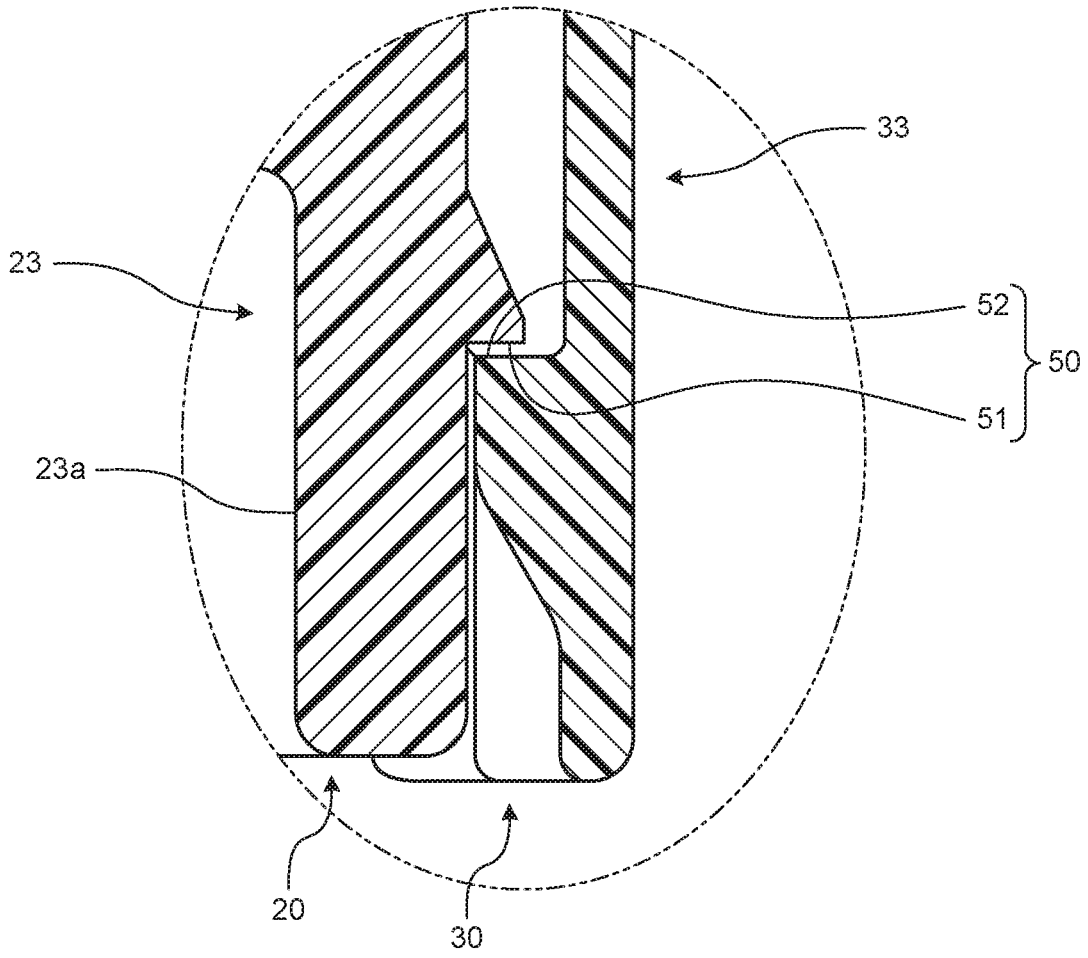
FIG. 9 is a partially enlarged diagram of a section taken along line Y-Y in FIG. 6.

A locking structure (hereinafter referred to as "first locking structure") 50 configured to lock motion of the housing and the cover opposite to the connection direction at the connection completed position is provided between the housing 20 and the cover 30 (FIGS. 1 to 3 and 9). The first locking structure 50 includes a first lock body 51 provided to the housing 20, and a second lock body 52 provided to the cover 30 (FIGS. 1, 3, and 9). The first lock body 51 and the second lock body 52 are disposed opposite to each other to lock motion of the housing 20 and the cover 30 opposite to the connection direction when the housing 20 and the cover 30 are at the connection completed position.

In the connector 1 of the present embodiment, the first locking structures 50 are provided at two places: between the first protection body 23 and the third wall 33 and between the second protection body 24 and the fourth wall 34. In this example, each first lock body 51 is formed as a protrusion, and each second lock body 52 is formed as a lock wall that is engaged with the first lock body 51. The first lock body 51 protrudes outward from the outer wall surface of the corresponding one of the first protection body 23 and the second protection body 24. The second lock body 52 is formed at the inner wall surface of the corresponding one of the third wall 33 and the fourth wall 34. The first locking structures 50 at the two places are provided so that the first lock bodies 51 thereof protrude in directions opposite to each other.

Figure 6:
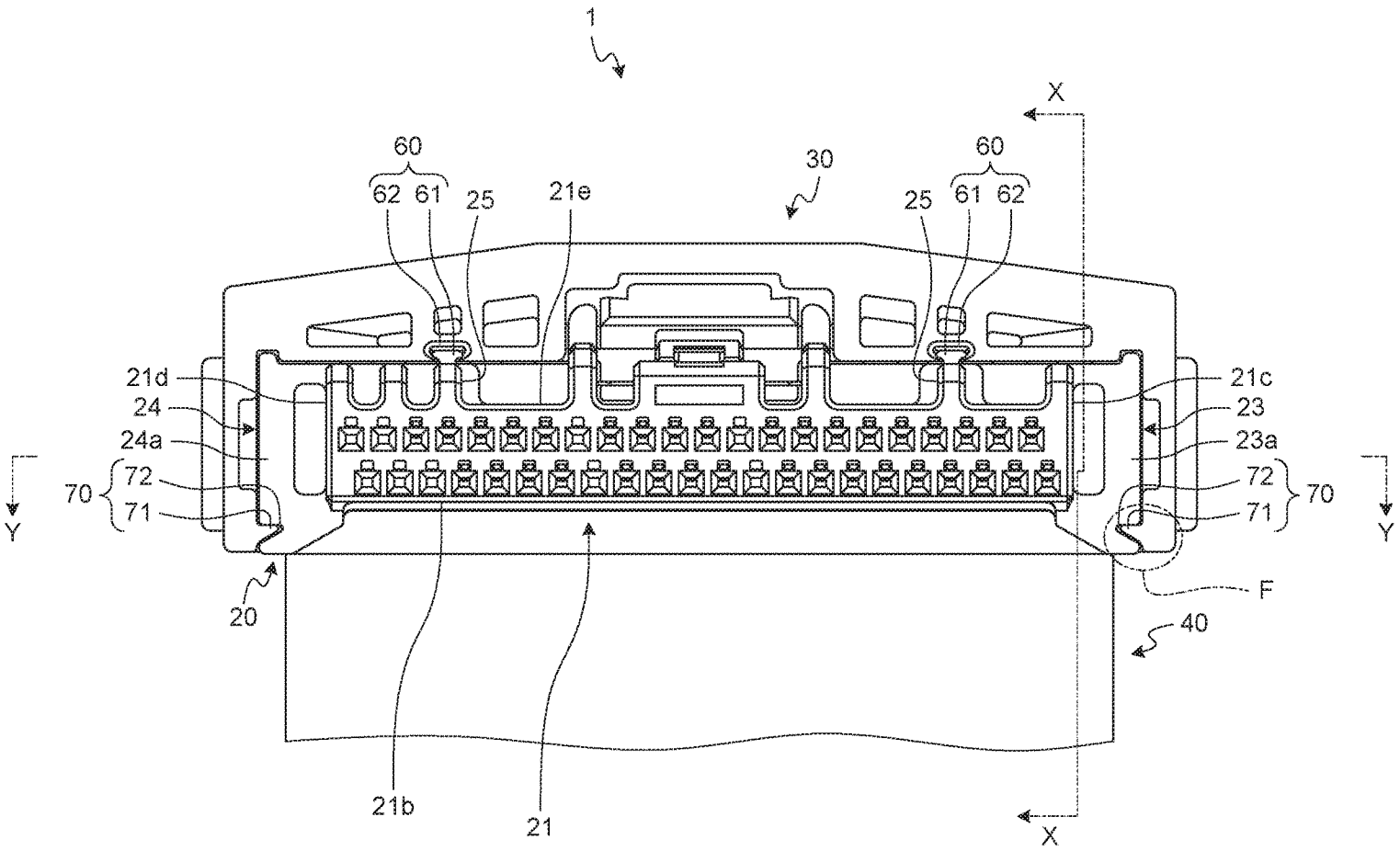
FIG. 6 is a plan view illustrating the connector of the embodiment.

In addition, a locking structure (hereinafter referred to as "second locking structure") 60 configured to lock motion of the housing 20 and the cover 30 in a separation direction among directions orthogonal to the connection direction at the connection completed position is provided between the housing 20 and the cover 30 (FIGS. 3 to 6). The second locking structure 60 includes a first lock body 61 provided to the housing 20, and a second lock body 62 provided to the cover 30 (FIGS. 3 and 6).

In the second locking structure 60 of this example, the first lock body 61 as a protrusion protrudes from the reinforcement ribs 25, and the second lock body 62 as a lock groove that is engaged with the first lock body 61 is formed at the second wall 32 of the cover 30. The first lock body 61 and the second lock body 62 each have a stereoscopic shape having a substantially trapezoid section orthogonal to the connection direction of the housing 20 and the cover 30 and extending in the connection direction. In each of the first lock body 61 and the second lock body 62, the upper base of the substantially trapezoid orthogonal section is positioned on the fifth outer wall surface 21*e* side. With this configuration, the first lock body 61 and the second lock body 62 lock motion of the housing 20 and the cover 30 in the separation direction when the housing 20 and the cover 30 are at the connection completed position. The first lock body 61 and the second lock body 62 also serve as a guiding structure for connecting the housing 20 and the cover 30 through insertion. The connector 1 of the present embodiment includes the second locking structures 60 at two places.

In addition, a guiding structure 70 configured to guide the housing 20 and the cover 30 in the connection direction is provided between the housing 20 and the cover 30 (FIGS. 1 to 6 and 10 to 14). The guiding structure 70 includes a wedge guiding protrusion 71 that is a protrusion provided to one of the housing 20 and the cover 30, has a wedge-shaped section orthogonal to the connection direction, and extends in the connection direction, and a wedge guiding groove 72 that is a groove provided to the other of the housing 20 and the cover 30, has a wedge-shaped section orthogonal to the connection direction, and extends in the connection direction to guide and be guided by the wedge guiding protrusion 71 being inserted in the connection direction (FIGS. 1, 3, 5, 6, and 14).

The wedge guiding protrusion 71 and the wedge guiding groove 72 are formed to have two pairs of a protrusion-side wall surface 71*a* and a groove-side wall surface 72*a* disposed opposite to each other (FIGS. 10 to 14) and have a gap between the protrusion-side wall surface 71*a* and the groove-side wall surface 72*a* of each pair.

Figure 10:
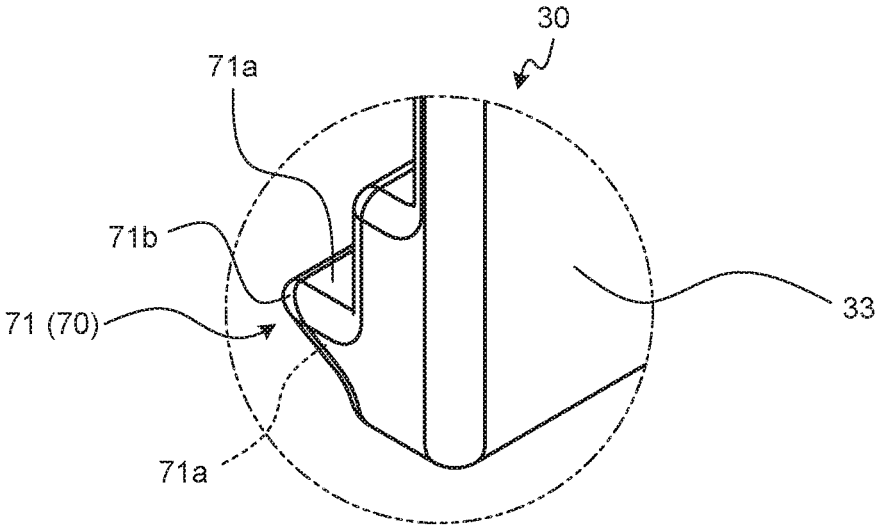
FIG. 10 is an enlarged view of Part B in FIG. 3.
Figure 11:
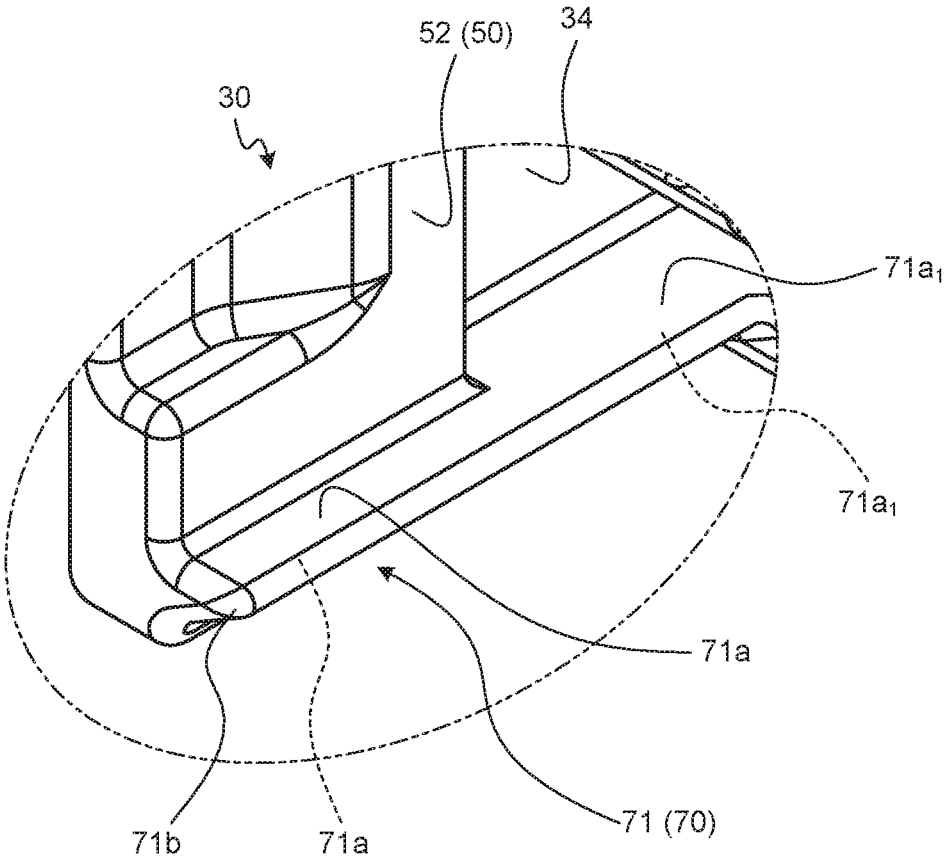
FIG. 11 is an enlarged view of Part C in FIG. 3.
Figure 12:
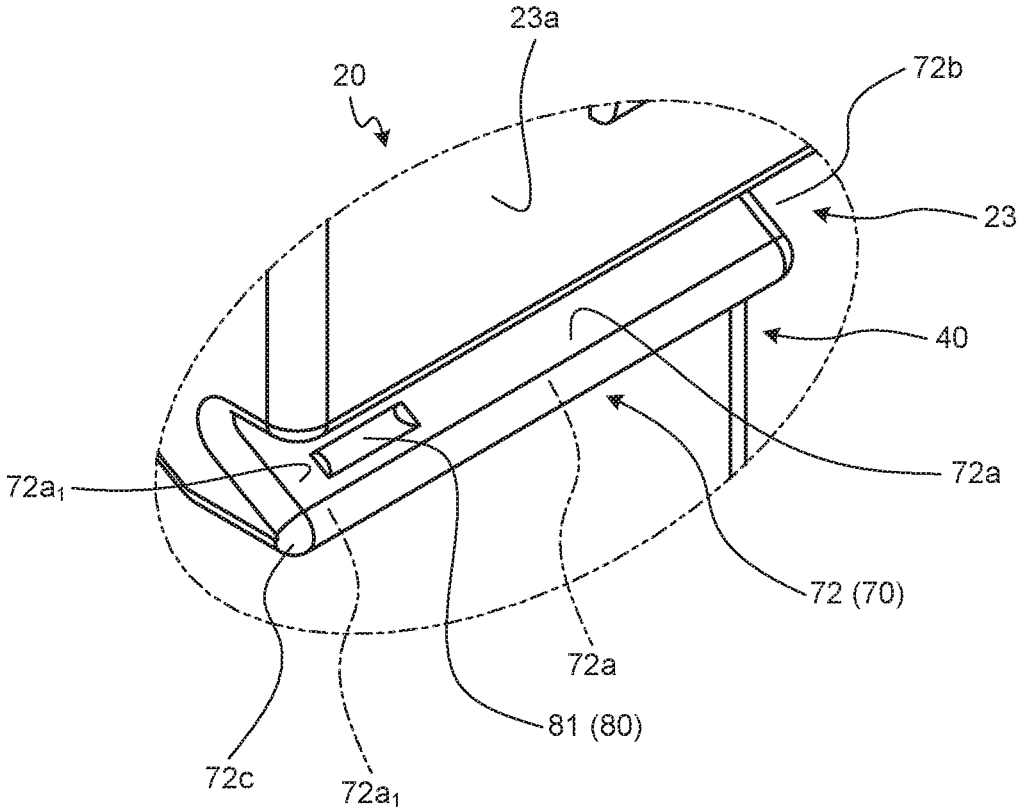
FIG. 12 is an enlarged view of Part D in FIG. 3.
Figure 13:
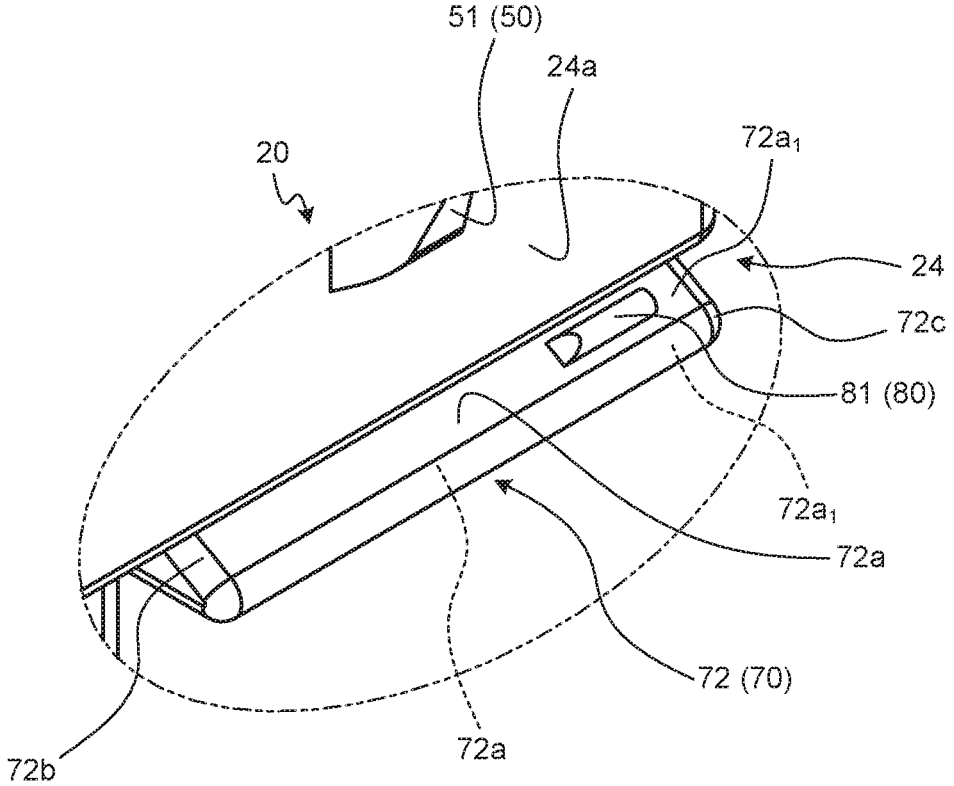
FIG. 13 is an enlarged view of Part E in FIG. 4.
Figure 14:
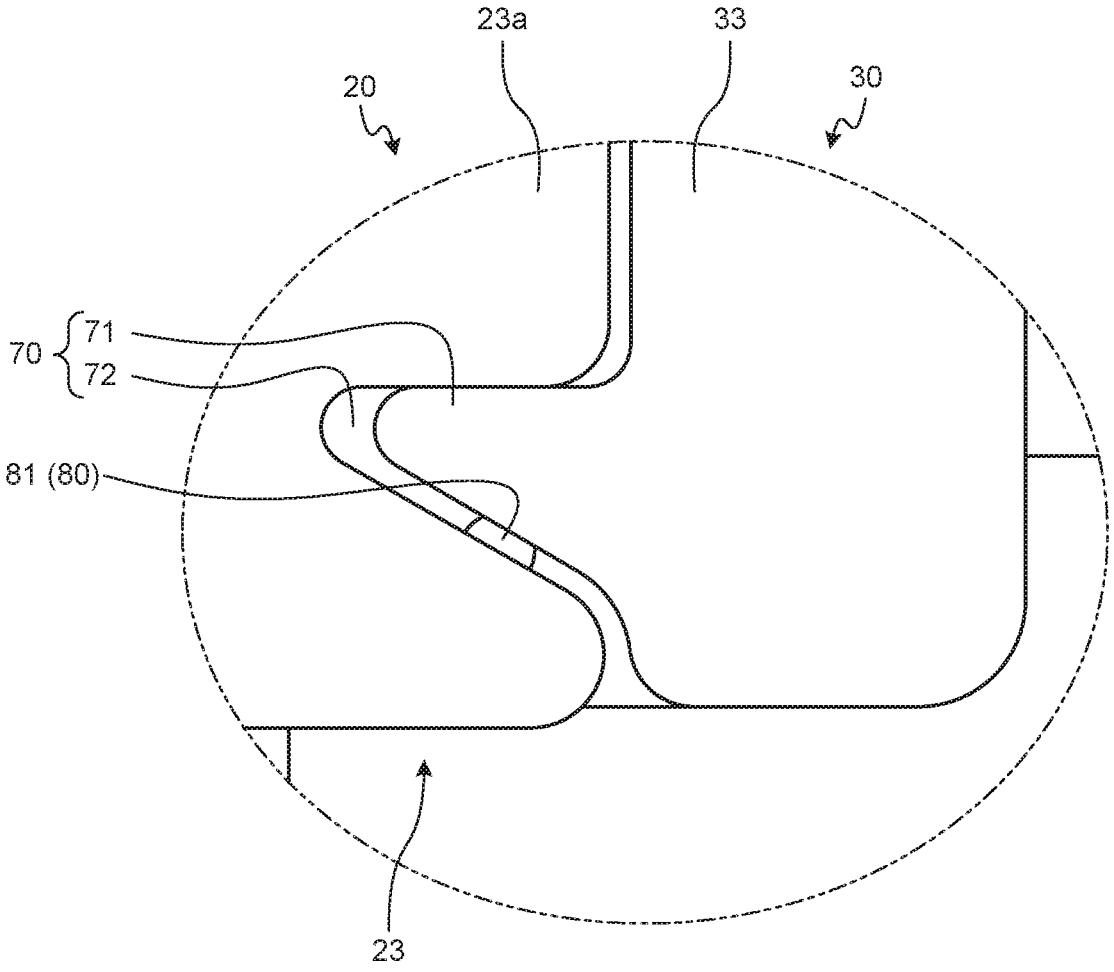
FIG. 14 is an enlarged view of Part F in FIG. 6.

The wedge guiding protrusion 71 of this example has a leading end 71*b* at the starting point of insertion into the wedge guiding groove 72 in the connection direction (FIGS. 10 and 11). The wedge guiding groove 72 of this example has a leading end at an insertion opening 72*b* through which the wedge guiding protrusion 71 is inserted in the connection direction from the leading end 71*b*, and has a back end 72*c* at a place where the leading end 71*b* of the wedge guiding protrusion 71 is inserted when the housing 20 and the cover 30 move to the connection completed position (FIGS. 12 and 13). The protrusion-side wall surface 71*a* of the wedge guiding protrusion 71 includes a back end part 71$a_1$ that is inserted through the insertion opening 72*b* when the housing 20 and the cover 30 move to the connection completed position and is positioned opposite to the groove-side wall surface 72*a* of the wedge guiding groove 72 after the housing 20 and the cover 30 have moved to the connection completed position (FIG. 11). The groove-side wall surface 72*a* of the wedge guiding groove 72 includes, at the back end 72*c* of the wedge guiding groove 72, a back end part 72$a_1$ that is positioned opposite to the protrusion-side wall surface 71*a* of the leading end 71*b* of the wedge guiding protrusion 71 after the housing 20 and the cover 30 have moved to the connection completed position (FIGS. 12 and 13).

The guiding structures 70 are provided at two places between the housing 20 and the cover 30 of this example. The guiding structures 70 at the two places are provided so that the wedge guiding protrusions 71 protrude in directions opposite to each other. The wedge guiding protrusions 71 of this example are provided to the third wall 33 and the fourth wall 34 of the cover 30. In this example, the wedge guiding protrusions 71 are disposed opposite to each other and formed at sides of the rectangular third wall 33 and the rectangular fourth wall 34. The wedge guiding grooves 72 of this example are provided to the first protection body 23 and the second protection body 24 of the housing 20. The wedge guiding groove 72 of the first protection body 23 is disposed adjacent to the flat plate part 23*a* in the flat plane direction of the flat plate part 23*a*. The wedge guiding groove 72 of the second protection body 24 is disposed adjacent to the flat plate part 24*a* in the flat plane direction of the flat plate part 24*a*.

In addition, a holding structure 80 configured to hold the housing 20 and the cover 30 at the connection completed position is provided between the housing 20 and the cover 30 (FIGS. 1 to 4 and 12 to 14). The holding structure 80 includes a press-fit protrusion 81 on at least one of the protrusion-side wall surface 71*a* and the groove-side wall surface 72*a* disposed opposite to each other in at least one of the two pairs, the press-fit protrusion 81 being configured to hold the corresponding wedge guiding protrusion 71 and groove 72 in a press-fitted state when the housing 20 and the cover 30 are at the connection completed position. Accordingly, in the connector 1, backlash due to the gap between each wedge guiding protrusion 71 and the corresponding wedge guiding groove 72 is reduced when the housing 20 and the cover 30 are at the connection completed position. Thus, in the connector 1, generation of unnecessary sound between the housing 20 and the cover 30, for example, when an external input due to vehicle driving or the like is applied is reduced. Moreover, in the connector 1, generation of vibration of the housing 20 and the cover 30 attributable to backlash when such an external input is applied is reduced, and thus degradation of durability of the housing 20 and the cover 30 can be reduced. Accordingly, the connector 1 of the present embodiment can have improved sound-vibration reduction capability.

The holding structures 80 of this example are provided to the guiding structures 70 at the two places. In this example, the press-fit protrusion 81 is formed as a protrusion on one of the two groove-side wall surfaces 72*a* of the wedge guiding groove 72 of each of the guiding structures 70 at the two places.

The press-fit protrusion 81 is desirably disposed to provide a gutter along the gap between the wedge guiding protrusion 71 and the wedge guiding groove 72 until the housing 20 and the cover 30 move to the connection completed position and to hold the wedge guiding protrusion 71 and the wedge guiding groove 72 in a press-fitted state after the housing 20 and the cover 30 have moved to the connection completed position. For example, the press-fit protrusion 81 is provided to the back end part 71$a_1$ of the protrusion-side wall surface 71*a* when provided to the protrusion-side wall surface 71*a*, or is provided to the back end part 72$a_1$ of the groove-side wall surface 72*a* when provided to the groove-side wall surface 72*a*. Accordingly, in the connector 1, friction resistance between the wedge guiding protrusion 71 and the wedge guiding groove 72 is reduced until the housing 20 and the cover 30 move to the connection completed position. In particular, in the connector 1, the wedge guiding protrusion 71 and the wedge guiding groove 72 have wedge shapes in each of the guiding structures 70 at the two places. Thus, the number of wall surfaces (pairs of the protrusion-side wall surface 71*a* and the groove-side wall surface 72*a* disposed opposite to each other) that are likely to contact at connection through insertion is four, which is a small number, and accordingly, the effect of reducing friction resistance between the wedge guiding protrusion 71 and the wedge guiding groove 72 is high. Thus, in the connector 1, insertion force when the housing 20 and the cover 30 are to be connected with each other through insertion is reduced until the housing 20 and the cover 30 move to the connection completed position, which leads to improved operability of connecting the housing 20 and the cover 30. Moreover, in the connector 1, the wedge guiding protruded 71 and the wedge guiding groove 72 are held in a press-fitted state by the press-fit protrusion 81 after the housing 20 and the cover 30 have moved to the connection completed position, which can reduce backlash between the wedge guiding protrusion 71 and the wedge guiding groove 72. Thus, in the connector 1, the generation of unnecessary sound and the generation of vibration described above when the housing 20 and the cover 30 are at the connection completed position can be reduced. In this manner, the connector 1 can achieve both improvement of the operability of connecting the housing 20 and the cover 30 and improvement of the sound-vibration reduction capability.

In this example, the press-fit protrusion 81 is provided to the back end part 72$a_1$ of the groove-side wall surface 72*a* (FIGS. 12 and 13).

Figure 15:
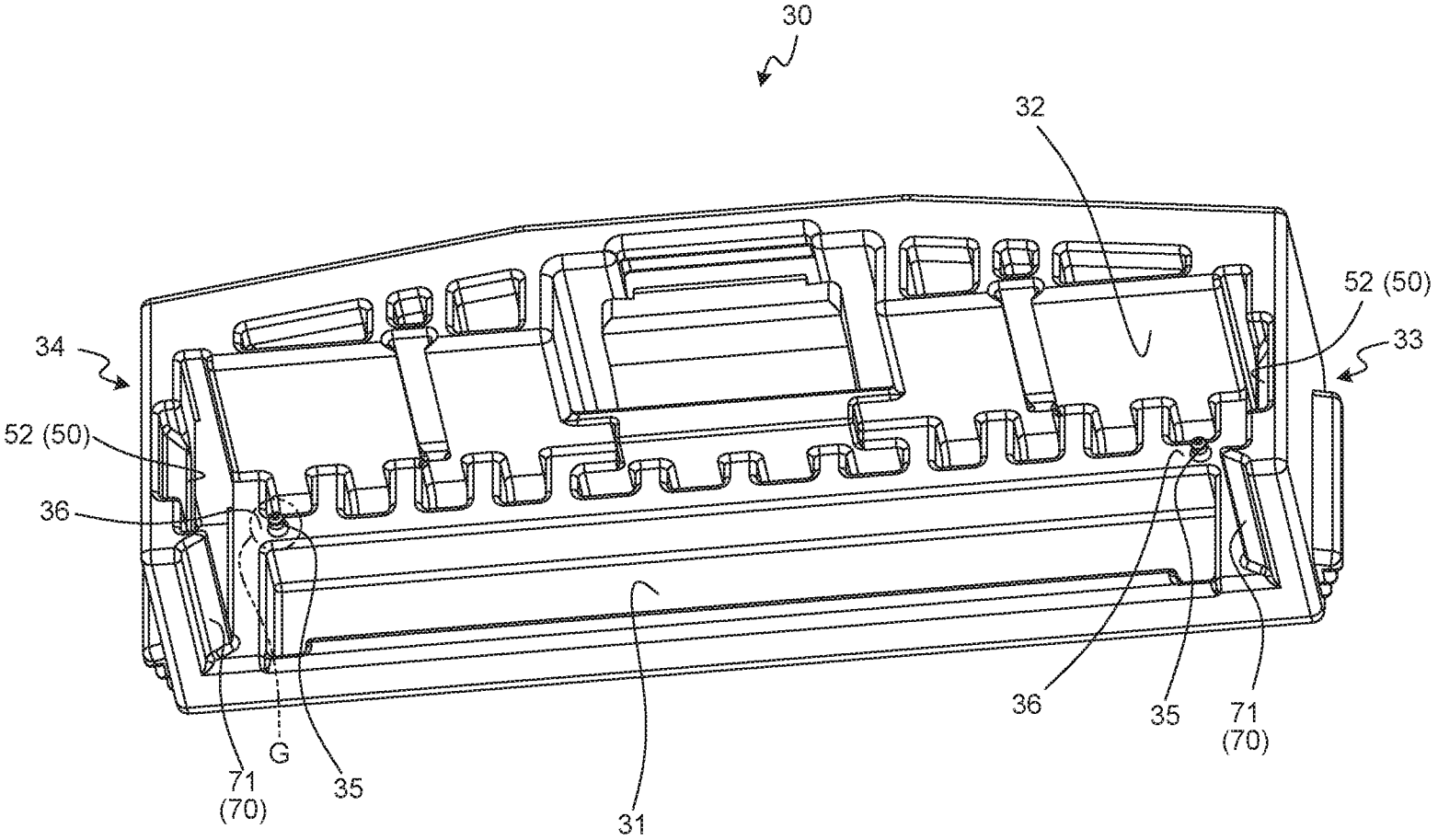
FIG. 15 is a perspective view illustrating a cover.
Figure 16:
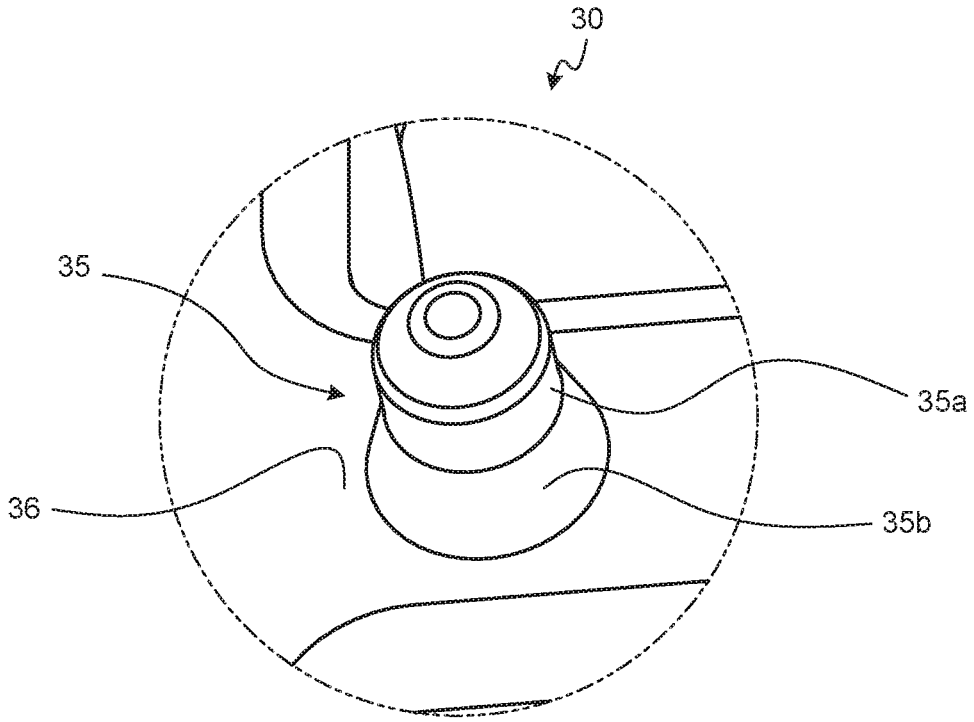
FIG. 16 is an enlarged view of Part G in FIG. 15.

The housing 20 and the cover 30 are connected with each other through insertion and fixed to each other by press fitting in this manner. In the connector 1 of the present embodiment, protrusions on the cover 30 side are inserted into through-holes of the conductive component 40 when the housing 20 and the cover 30 are at the connection completed position after the insertion connection. For this, the conductive component 40 includes at least two through-holes 43 provided on a side opposite to the extension region 40*b* side in the peripheral region 40$a_2$ (FIGS. 1, 2, and 4). The cover 30 includes a protrusion 35 that is perpendicularly provided for each through-hole 43 and inserted into the corresponding through-hole 43 with play when the housing 20 and the cover 30 are at the connection completed position (FIGS. 7, 15, and 16). The protrusion 35 includes a leading end part 35*a* that protrudes out of the through-hole 43 when the housing 20 and the cover 30 are at the connection completed position, and a back end part 35*b* that is inserted into the through-hole 43 in this case (FIGS. 7 and 16). In the housing body 21, a groove part 26 into which the leading end part 35*a* of the protrusion 35 protruding out of the through-hole 43 enters is formed to prevent the leading end part 35*a* from contacting the first outer wall surface 21*a* (FIG. 7).

In the connector 1, each protrusion 35 is inserted into the corresponding through-hole 43 from the leading end part 35*a* as the housing 20 and the cover 30 are connected with each other through insertion. In the connector 1, play based on the maximum value of tolerance variance is provided between the through-hole 43 and the protrusion 35. With this configuration, in the connector 1, the protrusion 35 can be inserted into the through-hole 43 as the housing 20 and the cover 30 are connected with each other through insertion.

In the connector 1, when the electrical connection part 12 of each terminal clasp 10 is soldered to the corresponding conductor of the conductive component 40, the side 40*a* (the electrical connection region 40$a_1$ and the peripheral region 40$a_2$) of the conductive component 40 placed on the first outer wall surface 21*a* as the installation surface is pressed against the first outer wall surface 21*a* by a jig or the like. However, in the connector 1, since the fitting protrusions 22, which are fitted on the extension region 40*b* side in the peripheral region 40$a_2$ of the conductive component 40, are already provided on the housing 20 side, the side 40*a* potentially cannot be pressed by a jig or the like or a region on which the pressing is performed is potentially restricted when the protrusions 35 on the side opposite to the extension region 40*b* side in the peripheral region 40$a_2$ are provided on the housing 20 side. In addition, the protrusions 35 provided on the housing 20 side potentially interfere with a nozzle of a soldering device or the like. Thus, the protrusions 35 are provided to the cover 30 in the connector 1. With this configuration, the connector 1 can prevent degradation of the quality of connection between the electrical connection part 12 of each terminal clasp 10 and the electrical connection part of the corresponding conductor in the conductive component 40.

In the connector 1 of the present embodiment, the side opposite to the extension region 40*b* side in the peripheral region 40$a_2$ of the conductive component 40 may be sandwiched between the housing 20 and the cover 30 when the housing 20 and the cover 30 are at the connection completed position, thereby further reducing the load on the place where the electrical connection part 12 of each terminal clasp 10 is connected with the electrical connection part of the corresponding conductor in the conductive component 40. To achieve this, the cover 30 includes a lock part 36 that presses the periphery of each through-hole 43 in the peripheral region 40$a_2$ against the first outer wall surface 21*a* as the installation surface when the housing 20 and the cover 30 are at the connection completed position (FIGS. 7, 15, and 16).

In the connector 1, when the housing 20 and the cover 30 are at the connection completed position, each lock part 36 of the cover 30 presses the periphery of the corresponding through-hole 43 in the peripheral region 40$a_2$ against the first outer wall surface 21*a* as the installation surface so that the periphery of the through-hole 43 is sandwiched between the lock part 36 and the first outer wall surface 21*a*. Accordingly, in the connector 1, when pulling force or force opposite to the pulling force is applied to the extension region 40*b* of the conductive component 40, the effect of reducing transfer of the force to the electrical connection region 40$a_1$ is enhanced, thereby further reducing the application of load to the place where the electrical connection part 12 of each terminal clasp 10 is connected with the electrical connection part of the corresponding conductor in the conductive component 40. In this manner, the connector 1 can further reduce the load on the connection place, thereby achieving further stabilization of the quality of energization between each terminal clasp 10 and the conductive component 40. In addition, in the connector 1, since backlash between the housing 20 and the cover 30 is reduced by the holding structure 80, the sandwiched state of the conductive component 40 by the through-holes 43, the protrusions 35, and the lock parts 36 can be maintained. In this manner, the connector 1 can maintain the stabilized quality of energization between each terminal clasp 10 and the conductive component 40.

The through-holes 43 are desirably provided at two corner parts, respectively, on the side opposite to the extension region 40*b* side in the peripheral region 40$a_2$, the two corner parts being arranged in the direction orthogonal to the extension direction of the extension region 40*b*. Accordingly, the conductive component 40 is held while the electrical connection region 40$a_1$ is surrounded by the lock parts 36, the fitting holes 42, and the fitting protrusions 22 at four corners. Thus, the connector 1 can achieve a high effect of reducing a load on the place where the electrical connection part 12 of each terminal clasp 10 is connected with the electrical connection part of the corresponding conductor in the conductive component 40, thereby achieving further stabilization of the quality of energization between each terminal clasp 10 and the conductive component 40.

In the connector 1 of this example, two sets of a through-hole 43, a protrusion 35, and a lock part 36 are provided at the two corner parts, respectively. The through-hole 43 of this example is formed as a circular through-hole (FIGS. 1 and 2). In the protrusion 35 of this example, the leading end part 35*a* is formed in a cylindrical shape having a leading end of a circular truncated cone shape and having a diameter smaller than that of the through-hole 43. The back end part 35*b* is formed in a circular truncated cone shape having a diameter that increases as the position moves toward the base and that is smaller than that of the through-hole 43 (FIGS. 7 and 16).

As described above, when force is applied to the extension region 40*b* of the conductive component 40 in the connector 1 of the present embodiment, a reduced load is applied, along with the force, on the place where the electrical connection part 12 of each terminal clasp 10 is connected with the electrical connection part of the corresponding conductor in the conductive component 40. Thus, the connector 1 can achieve stabilization of the quality of energization between each terminal clasp 10 and the conductive component 40.

In a connector according to the embodiment, when force such as pulling force is applied to the extension region of the conductive component, the force is transferred from the periphery of each fitting hole to the outer peripheral surface of the corresponding fitting protrusion. Accordingly, in the connector, the force applied to the extension region can be received by the fitting protrusion. Thus, in the connector, the force is prevented from being transferred to the electrical connection region, which reduces application of load to the place where the electrical connection part of each terminal clasp is connected with the electrical connection part of the corresponding conductor in the conductive component. In this manner, the connector according to the present embodiment can reduce a load on the connection place, thereby achieving stabilization of the quality of energization between each terminal clasp and the conductive component.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal clasp;

a flexible flat conductive component in which a conductor and an insulator that are flexible are stacked and formed in a flat plane, the conductor being connected with an electrical connection part of the terminal clasp provided perpendicular to the plane;

a housing in which a terminal connection part of the terminal clasp is stored in a storage room and the electrical connection part of the terminal clasp protrudes out of an opening of the storage room; and a cover that is connected with the housing through insertion and covers the electrical connection part from outside together with at least part of the housing, wherein the flexible flat conductive component includes an electrical connection region in which the electrical connection part is connected with the conductor, a peripheral region enclosing the electrical connection region, an extension region extending out of the housing and the cover connected with each other, and at least two fitting holes provided on the extension region side in the peripheral region, the housing includes an installation surface through which the opening of the storage room is provided and on which flat planes of the electrical connection region and the peripheral region are placed, and a fitting protrusion that is provided for each fitting hole perpendicularly from the installation surface and is fitted into the fitting hole without backlash, the flexible flat conductive component includes at least two through-holes provided on a side opposite to the extension region side in the peripheral region, and the cover includes a protrusion that is perpendicularly provided for each through-hole and inserted into the through-hole with play when the housing and the cover are at a connection completed position.

2. The connector according to claim 1, wherein the fitting holes are provided at two corner parts, respectively, on the extension region side in the peripheral region, the two corner parts being arranged in a direction orthogonal to a direction in which the extension region extends.

3. The connector according to claim 1, wherein the cover includes a lock part that presses a periphery of each through-hole in the peripheral region against the installation surface when the housing and the cover are at the connection completed position.

4. The connector according to claim 3, wherein a holding structure configured to hold the housing and the cover at the connection completed position is provided between the housing and the cover.

5. The connector according to claim 4, wherein the through-holes are provided at two corner parts, respectively, on the side opposite to the extension region side in the peripheral region, the two corner parts being arranged in a direction orthogonal to a direction in which the extension region extends.

6. The connector according to claim 3, wherein the through-holes are provided at two corner parts, respectively, on the side opposite to the extension region side in the peripheral region, the two corner parts being arranged in a direction orthogonal to a direction in which the extension region extends.

7. The connector according to claim 1, wherein the through-holes are provided at two corner parts, respectively, on the side opposite to the extension region side in the peripheral region, the two corner parts being arranged in a direction orthogonal to a direction in which the extension region extends.

* * * * *